US011278092B2

(12) United States Patent
Grafilo

(10) Patent No.: US 11,278,092 B2
(45) Date of Patent: Mar. 22, 2022

(54) WALLET AND CARD HOLDER

(71) Applicant: Edward Grafilo, San Francisco, CA (US)

(72) Inventor: Edward Grafilo, San Francisco, CA (US)

( * ) Notice: Subject to any disclaimer, the term of this patent is extended or adjusted under 35 U.S.C. 154(b) by 319 days.

(21) Appl. No.: 16/450,677

(22) Filed: Jun. 24, 2019

(65) Prior Publication Data

US 2020/0000190 A1 Jan. 2, 2020

Related U.S. Application Data

(60) Provisional application No. 62/693,033, filed on Jul. 2, 2018.

(51) Int. Cl.
*A45C 1/06* (2006.01)

(52) U.S. Cl.
CPC ..... *A45C 1/06* (2013.01); *A45C 2001/065* (2013.01)

(58) Field of Classification Search
CPC .... A45C 1/06; A45C 2001/065; A45C 11/182
USPC ..... 150/132, 149
See application file for complete search history.

(56) References Cited

U.S. PATENT DOCUMENTS 2,175,327 A 10/1939 Thornhill et al.
2,317,748 A * 4/1943 Exline ..... B42D 5/022 281/19.1
2,383,108 A * 8/1945 Cibert ..... A45C 1/06 150/132
2,746,508 A * 5/1956 Doughty ..... B60C 27/12 152/218
7,748,086 B2 * 7/2010 Bridgefarmer ..... A45C 11/182 24/17 B
9,648,931 B2 5/2017 Sha et al.
10,201,216 B2 2/2019 Geer
2002/0194711 A1 * 12/2002 Stampler ..... A45C 11/18 24/300
2009/0211062 A1 * 8/2009 Preston-Hall ..... A45C 11/182 24/17 B
2013/0056119 A1 * 3/2013 Henriette ..... A45C 11/182 150/137
2016/0073747 A1 * 3/2016 Whichel ..... A45C 13/30 150/118
2017/0135452 A1 * 5/2017 Kane ..... A45C 13/185
2017/0202324 A1 * 7/2017 Van Geer ..... A45C 1/06

OTHER PUBLICATIONS

USPTO, Requirement for Restriction/Election Office Action issued in related U.S. Appl. No. 29/695,981 dated Jul. 2, 2020. (6 pages).

* cited by examiner

*Primary Examiner* — Sue A Weaver
(74) *Attorney, Agent, or Firm* — Laura M. King; Matrix Law Group, LLP

(57) ABSTRACT

A card and foldable currency carrying device is described. The device is made up of a substantially rectangular wallet assembly with a plurality of panels. The panels make up a compartment for holding one or more cards, including credit cards, debit cards, ATM cards, gift cards, driver's licenses, identification cards, library cards, and business cards, as well as foldable currency. The device also contains a strap member. The strap member is slidable along the wallet assembly between a first position and a second position.

11 Claims, 14 Drawing Sheets

WALLET AND CARD HOLDER

CROSS-REFERENCE TO RELATED APPLICATIONS

The present application claims the benefit of U.S. Provisional Patent Application No. 62/693,033 titled "Wallet and Card Holder," filed on Jul. 2, 2018, the contents of which are incorporated in this disclosure by reference in their entirety.

BACKGROUND

The present invention is directed towards a slim wallet and card holder device for holding foldable currency, credit cards or identification cards in a convenient, easy to use arrangement.

Previously, money clips have been used to hold folded currency and are designed to be carried in a pants or jacket pocket or other area. These money clips are fashioned from a single piece of bent or formed metal stock generally in the form of a spring clip and are available in a variety of materials. The money clip is currently not as widely used as it has been in the past, possibly due to the widespread use of credit cards and the accompanying need to conveniently and securely carry credit cards as well ATM cards, bank cards, business cards, access cards, gift cards, multi-tools, driver's licenses and other identification cards. Most money clips do not adequately accommodate cards, and those that do hold cards often pose the disadvantage of added weight and bulk caused by the need for a heavy spring attachment to hold the cards in place. While money clips are a convenient way to carry folded money, they do not work very well in carrying credit cards, driver's licenses or the like because the items tend to fail out of money clips or are bent, scratched, broken or destroyed by the money clip while being carried or removed.

Wallets are also used for carrying credit cards and foldable currency and can be carried in the user's front or rear pocket. However, wallets can be bulky and in some instances uncomfortable when the wearer is driving long distances or sitting for long periods of time. Additionally, wallets can be clearly visible in the user's pocket and can be a target for a thief. Furthermore, over time, when contents are are added and removed from a wallet, the wallet material stretches but doesn't retract when contents are removed, resulting in the contents falling out.

Thus, there is a need for a device that can accommodate foldable currency as well as credit cards, ATM cards, bank cards, business cards, access cards, gift cards, multi-tools, identification, and similar sized items. It is also contemplated that the device can be sized to accommodate a passport. The device is capable of being carried in any pocket and also be capable of carrying several credit cards and a quantity of foldable currency. The present invention is directed towards a such a device for carrying a number of credit sized cards, identification cards and foldable currency in a convenient, easy manner in a user's pants pocket, shirt pocket or the like.

SUMMARY

The present invention is directed to a card and foldable currency carrying device. The device contains a substantially rectangular wallet assembly comprising a plurality of panels, wherein the panels comprise a compartment for holding one or more cards and foldable currency. The device also contains a strap member, wherein the strap member is slidable along the wallet assembly between a first position and a second position. The device can carry cards such as credit cards, debit cards, ATM cards, gift cards, driver's licenses, identification cards, library cards, and business cards. It is contemplated that the device measures between about 2 inches to 4 inches wide, and between about 4 inches to 6 inches long. The wallet assembly can be constructed of at least one material selected from the group consisting of textiles, leather, cork, vegan leather, polyurethane synthetic leather, polyvinylchloride, silk and taffeta. The length of the strap member can be greater in dimension than the width of the strap member. The strap member can comprise a rectangular strip of elastic material, for example from about between 0.5 inches to 1.5 inches wide, and from about between 5 inches to 9 inches long. The strap member can comprises a rectangular strip of elastic material having a first end and a second end, and the first end and second end can be non-reversibly joined together. The strap member in the first position allows for the insertion of cards and money in the device, and wherein the strap member in the second position allows the cards and money to be retained in the device. The strap member can be constructed of at least one material selected from the group consisting of fabric, elastic, spandex, lycra-type fabric, and rubber.

BRIEF DESCRIPTION OF THE DRAWINGS

These and other features, aspects, and advantages of the present invention will become better understood with regard to the following description, appended claims, and accompanying drawings where:

DESCRIPTION

The present invention is directed towards devices, and methods of making the wallet and card holder for carrying a number of credit sized cards, identification cards and foldable currency in a convenient, easy manner in a user's pants pocket, shirt pocket or the like. It is also contemplated that the device can be sized to accommodate a passport. The wallet and card holder comprise a small, compact, low profile holder for carrying money, identification cards, credit cards and the like by the user.

The terms "a," "an," and "the" and similar terms used herein are to be construed to cover both the singular and the plural unless their usage in context indicates otherwise.

As used in this disclosure, except where the context requires otherwise, the term "comprise" and variations of the term, such as "comprising," "comprises" and "comprised" are not intended to exclude other additives, components, integers or steps. Thus, throughout this specification, unless the context requires otherwise, the words "comprise," "comprising" and the like, are to be construed in an inclusive sense as opposed to an exclusive sense, that is to say, in the sense of "including, but not limited to."

As used herein, "cards" refers to credit cards, debit cards, ATM cards, gift cards, driver's licenses, identification cards, library cards, business cards and the like.

As used herein, "stitching" refers to fastening, joining, securing, holding, or closing two or more items together.

As used herein, "joined" refers to securing, putting together, connecting, or bringing two or more items together.

Figure 1:
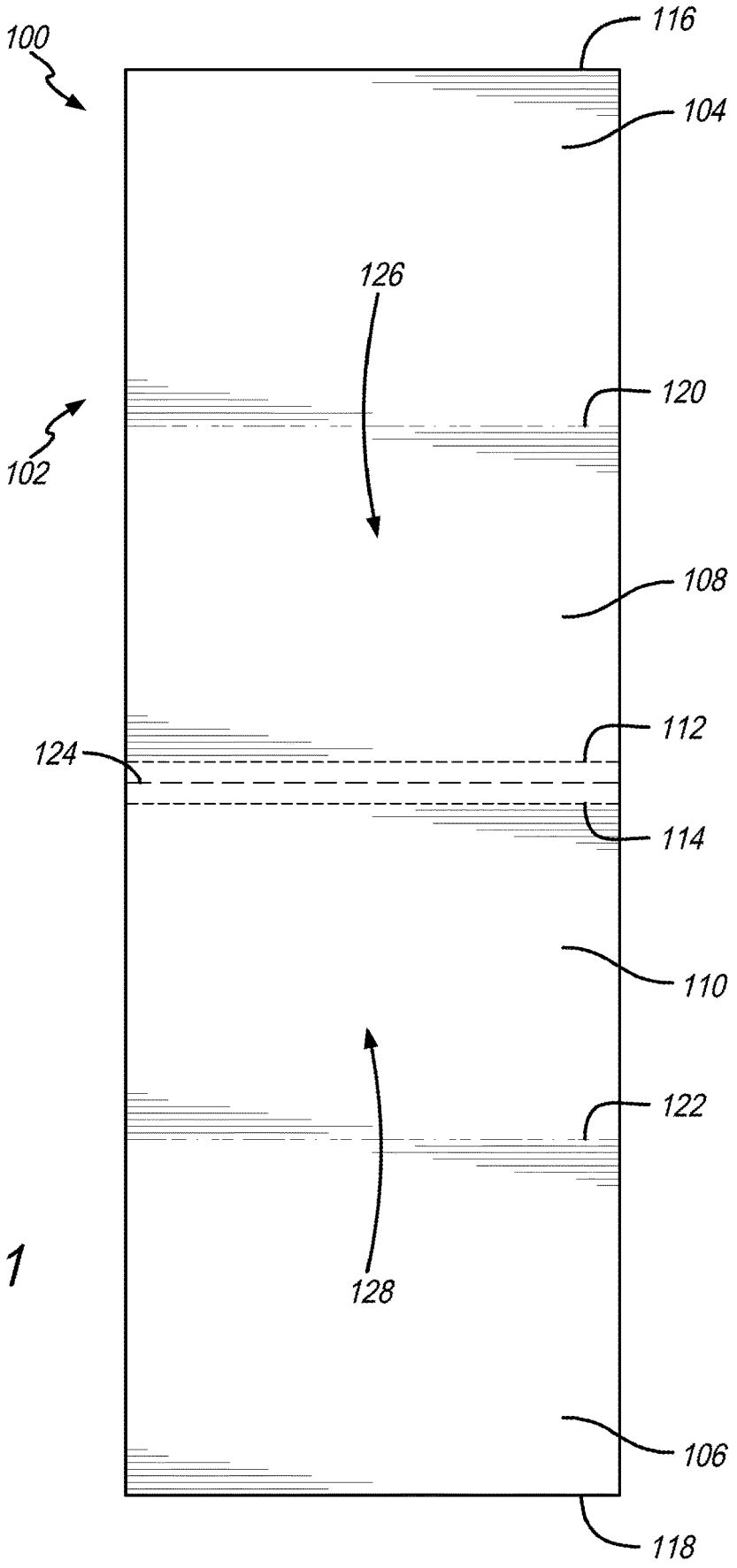
FIG. 1 is a front elevational view of one embodiment of the device of the present invention prior to assembly.
Figure 8:
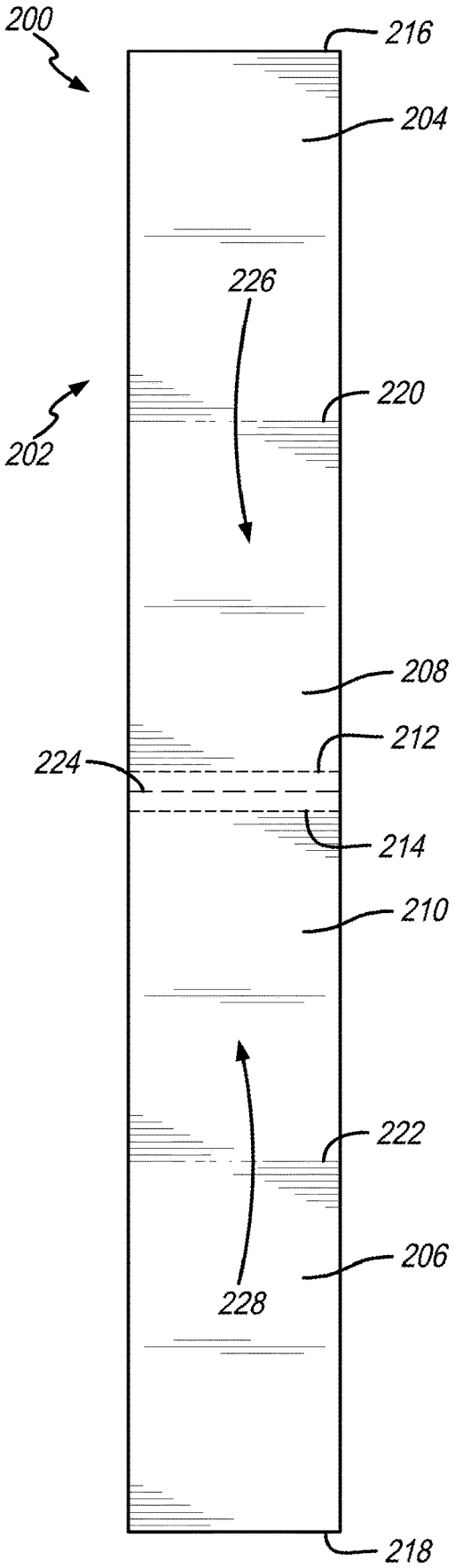
FIG. 8 is a front elevational view of an alternative embodiment of the device of the present invention prior to assembly.

The present invention is directed to a wallet and card holder 100, 200, 300 and method of making same. As shown in FIGS. 1 and 8, the wallet and holder 100, 200, 300 of the invention comprises a blank pattern 102, 202, 302 which is rectangular in shape and which can be cut or stamped from one or more durable materials. The durable material used for the blank pattern 102, 202, 302 can be any material, such as, for example, textiles, leather, cork, vegan leather, polyurethane synthetic leather, polyvinylchloride, Pellon 725 and 808, silk and taffeta. It is contemplated that the material used, or additional material can be added that can block or reduce external radiation, including electromagnetic radiation (EMR), electromagnetic fields (EMF), extremely low frequencies (ELF), radio frequencies (RF) and thermal radiation. If two or more materials are used for the blank pattern 102, 202, 302 the materials can be joined together by any means, such as by stitching or adhering the materials together.

Preferably, the blank pattern 102, 202, 302 is between about 0.01 to 0.1 inches thick, between about 2 and 5 inches wide, and between about 11 and 17 inches long. Preferably, the blank pattern 102, 202, 302 is 0.04 inches thick, 3.25 inches wide, and 12 inches long.

As shown in FIGS. 1, 2, 8 and 9 the blank pattern 102, 202 comprises a first panel 104, 204, a second panel 106, 206, a third panel 108, 208 and a fourth panel 110, 210. It is understood that these four panels are cut from one piece of material and are separated only by fold lines 120, 220, 122, 221, 124, 224 which divide the blank pattern 102, 202 into first panel 104, 204 and third panel 108, 208, second panel 106, 206 and fourth panel 110, 210, and third panel 108, 208 and fourth panel 110, 210 respectively. First panel 104, 204 and second panel 106, 206 form the inside of the wallet when folded, and third panel 108, 208 and fourth panel 110, 210 form the outside of the wallet when folded, as described below.

Optionally, prior to assembly, slots can be cut in blank pattern 102, 202 in the first panel 104, 204 or second panel 106, 206 in order to store credit cards, identification cards or the like (slots not shown in drawings). The slots can be strengthened by the addition of material behind the slot.

Figure 2:
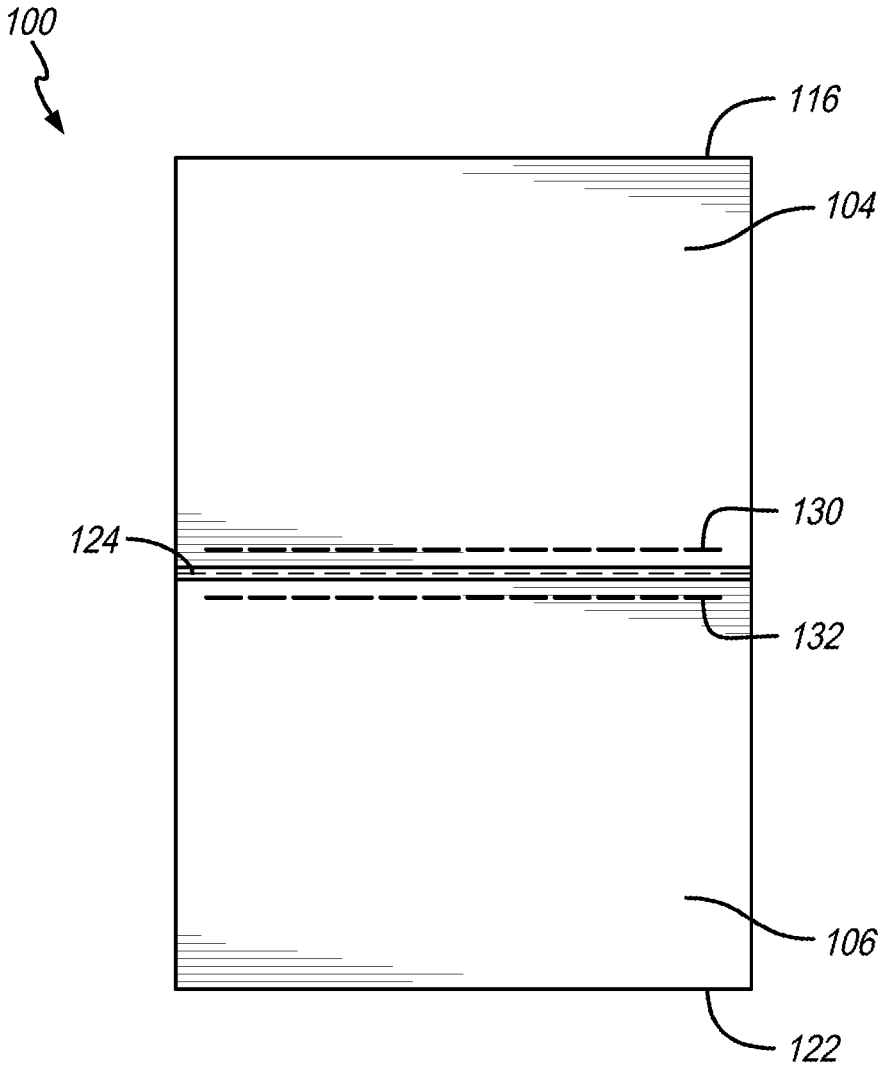
FIG. 2 is a front elevational view of the device shown in FIG. 1 after the material is folded between the first and second inner panels and the first and second outer panels.
Figure 3:
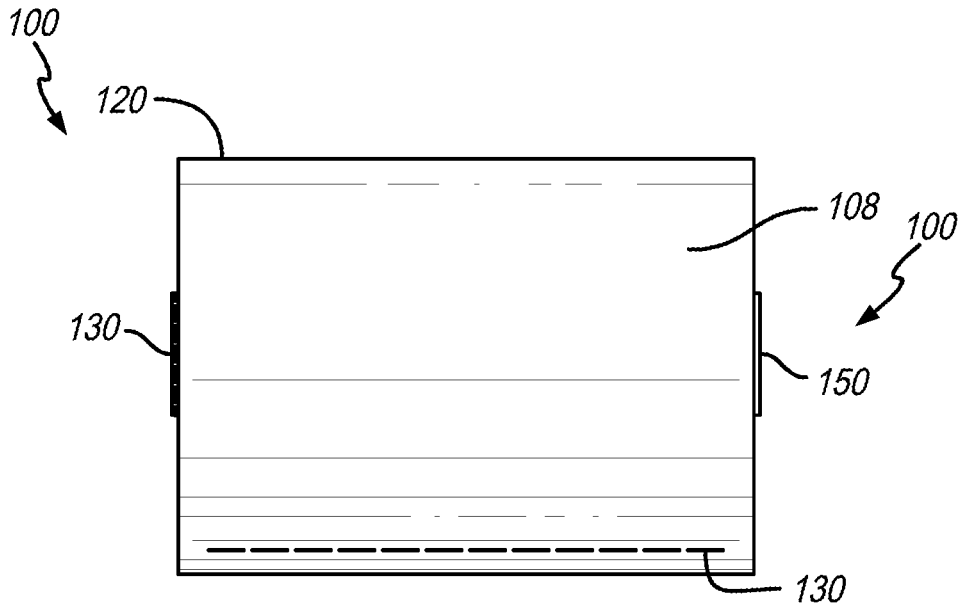
FIG. 3 is a front elevational view of the assembled device shown in FIG. 1.
Figure 4:
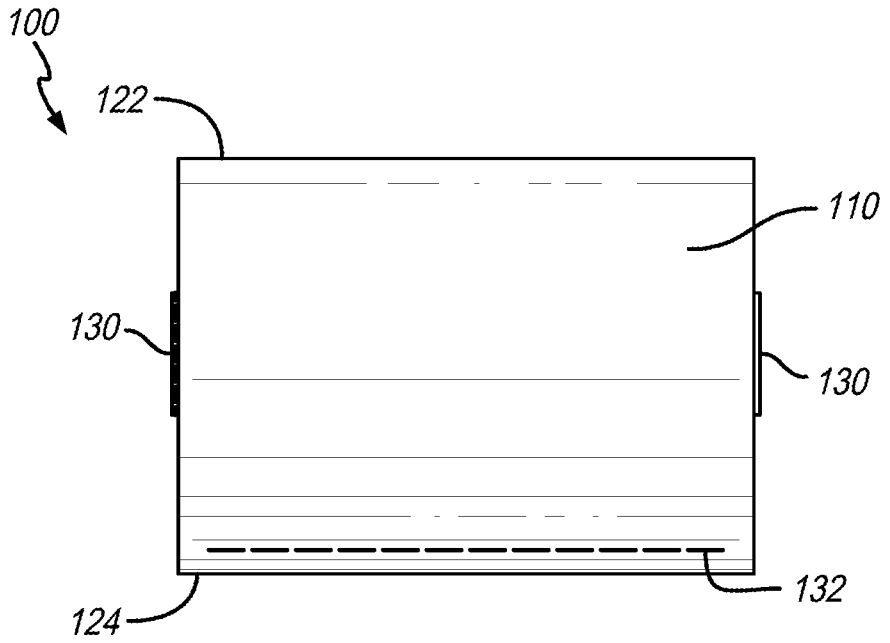
FIG. 4 is a rear elevational view of the assembled device shown in FIG. 1.
Figure 9:
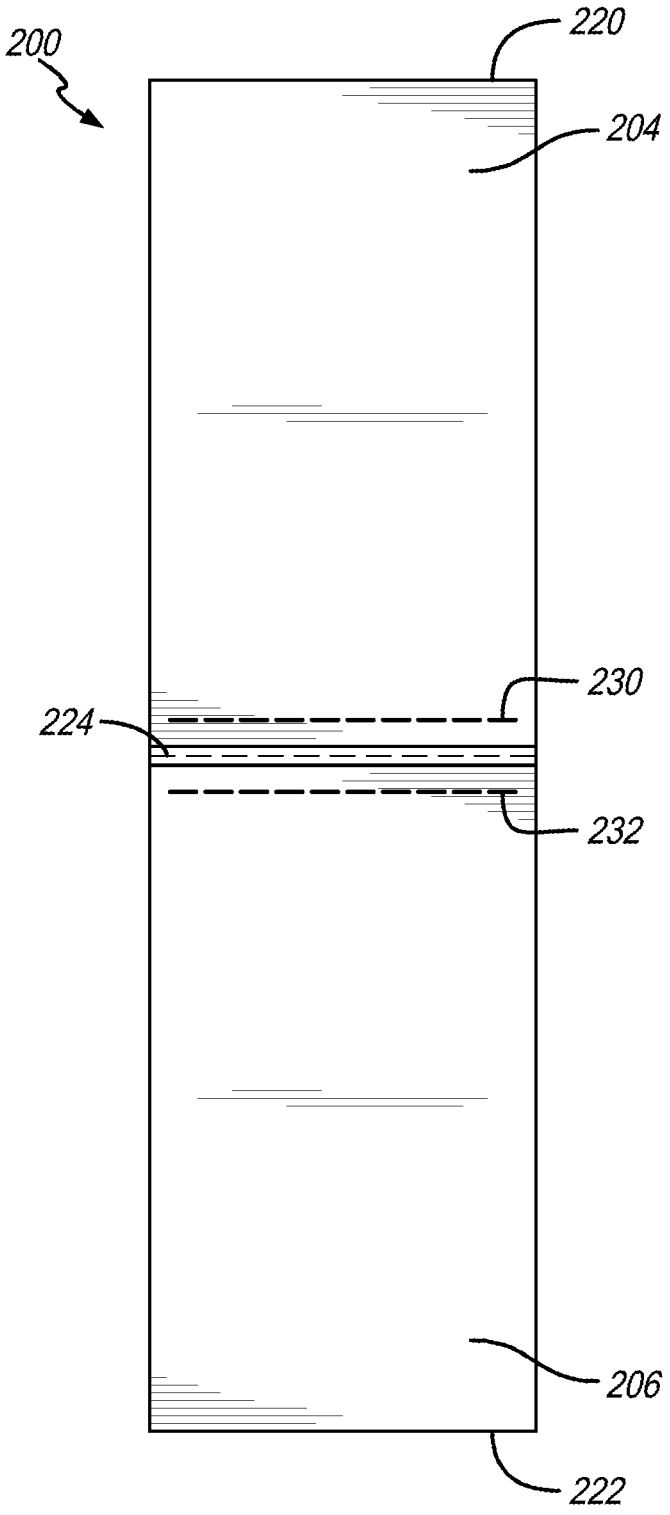
FIG. 9 is a front elevational view of the device shown in FIG. 8 after the material is folded between the first and second inner panels and the first and second outer panels.
Figure 10:
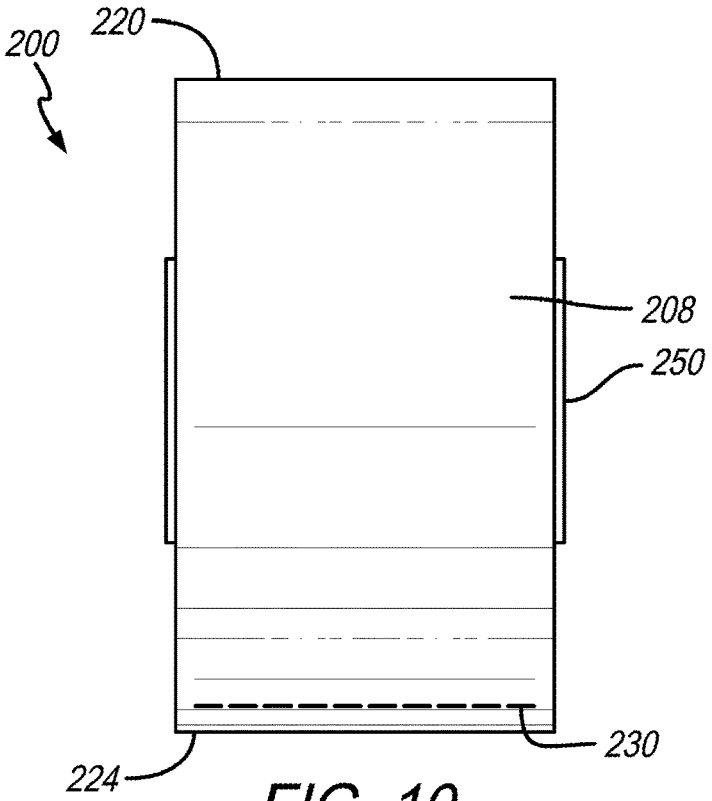
FIG. 10 is a front elevational view of the assembled device shown in FIG. 8.
Figure 11:
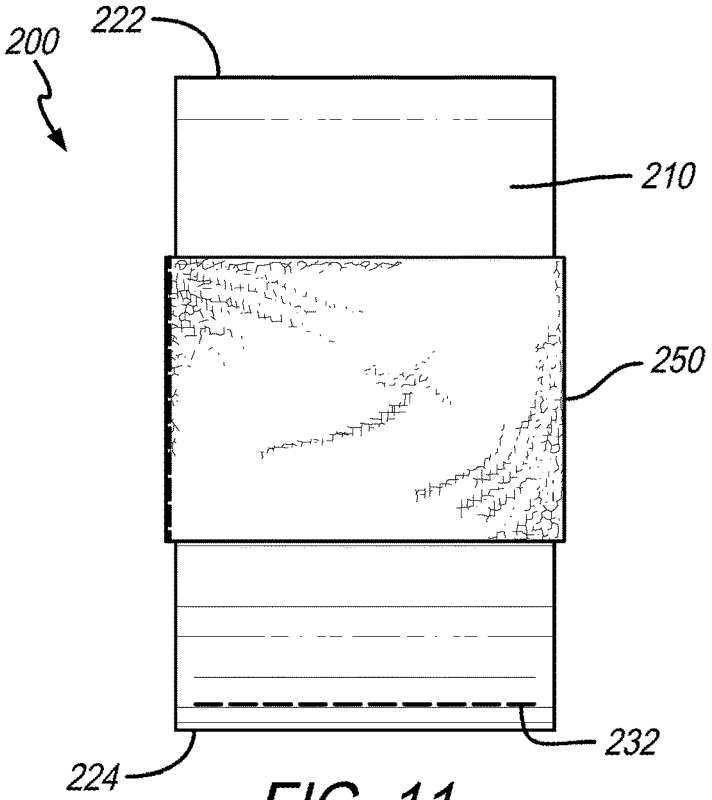
FIG. 11 is a rear elevational view of the assembled device shown in FIG. 8.

The manner in which the blank pattern 102, 202 is folded to provide an assembled wallet and card holder 100, 200 is illustrated in FIGS. 1-4 and 841. As seen by first folding arrow 126, 226 in FIGS. 1 and 8, the first panel 104, 204 is folded inwardly along first fold line 120, 220 so that the free end of the first panel 116, 216 aligns with first end line 112, 112 to create the third panel 108, 208. As seen by the second folding arrow 128, 228 the second panel 106, 206 is folded inwardly along second fold line 122, 222 so that the free end of the second panel 118, 218 aligns to the second end line 114, 214 to create fourth panel 110, 210. The first panel 104, 204 is joined by stitching 130, 230 or the like to third panel 108, 208. The second panel 106, 206 is joined by stitching 132, 232 or the like to fourth panel 110, 210. The resulting structure is shown in FIGS. 2 and 9.

The wallet and card holder 100, 200 is then folded again along fold line 124, 224 so that third panel 108, 208 and fourth panel 1/0, 210 are adjacent to each other, and first fold line 120, 220 and second fold line 122, 222 are adjacent to each other, as shown in FIGS. 3, 4, 10 and 11. The assembled wallet and card holder is between about 2 inches to 4 inches wide, and between about 4 inches to 6 inches long.

Optionally, a first rigid material 138, 238 can be inserted between the first panel 104, 204 and the third panel 108, 208, and a second rigid material 140, 240 can be inserted between the second panel 106, 206 and the fourth panel 110. The first rigid material 138, 238 and second rigid material 140, 240 can be any rigid material such as, for example, playing cards, plastic, plasticized cardboard, carbon fiber, aircraft grade aluminum, steel, fiberglass, polyvinylchloride or the like. The first rigid material 138, 238 and second rigid material 140, 240 can be sized to 3.375 inches by 2.125 inches (standard credit card or state identification card size, also called CR80) or 2.63 inches by 3.88 inches (standard government identification card size, also called CR100). Preferably, the first rigid material 138, 238 and second rigid material 140, 240 used is polyvinylchloride measuring 3.375 inches by 2.125 inches. The first rigid material 138, 238 and second rigid material 140, 240 can be held in place by the tension between the panels.

A resilient strap member 150, 250, shown in FIGS. 3-7 and 10-15 is used to hold the third panel 108, 208 and fourth panel 110, 210 adjacent to each other. Strap member 150, 250 can be made from any material, but is preferably made from a material that is expandable to a finished stretch of 50% to 100% so as to easily and securely hold several credit and other cards and foldable money. Exemplary material includes fabric, elastic, spandex, lycra-type fabric, and rubber. The strap member 150, 250 has a width of from about between 0.5 inches and 1.5 inches, and a length of from about between 5 to 9 inches such that, when joined together, the strap member 150 fits securely around the wallet and holder 100, 200. Preferably, strap member 150, 250 is 1 inch wide and 7.5 inches long.

In the embodiment shown in FIGS. 3-7, strap member 150 is threaded between the first panel 104 and the third panel 108, and the second panel 106 and the fourth panel 110. If first rigid material 138 and/or second rigid material 140 is present, the strap member 150 can be placed between the first rigid material 138 and/or second rigid material 140 and the first panel 104, second panel 106, third panel 108, or fourth panel 110. The strap member 150 is then joined together, such as by stitching, so that it forms an endless band around the assembled device. The strap member 150 can also be threaded between the first panel 104 and third panel 108, and across the fourth panel 110.

Alternatively, the strap member 250 can be threaded between the first panel 204 and the third panel 208, and across the fourth panel 210 as in the embodiment shown in FIGS. 10-15. The strap member 250 is then joined together, such as by stitching, so that it forms an endless band.

Once assembled, a compartment 134, 234 is formed between the first panel 104, 204 and second panel 106, 206. The compartment 134, 234 serves as a holder for storing currency, driver's license, business cards, credit card or the like. Optional slots can be added to first panel 104, 204 and second panel 106, 206, as described above. The user can digitally engage at least an end or side edge of the card inserted in the compartment 134, 234 in a finger pinching manner to slidably remove the card from the compartment 134, 234.

Figure 5:
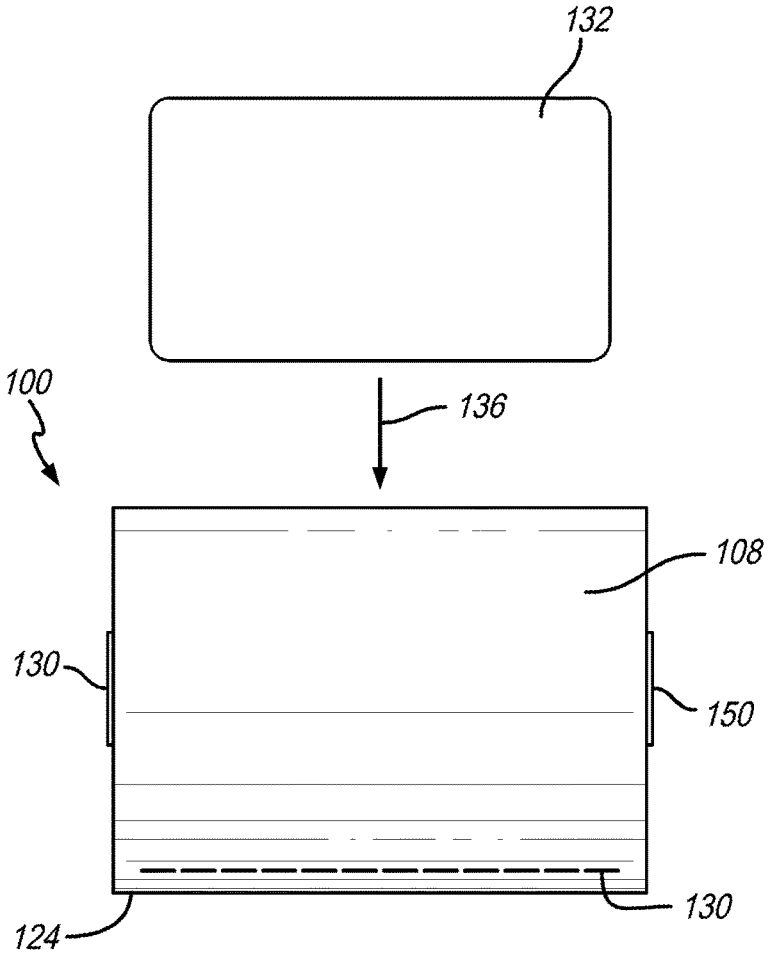
FIG. 5 is a front elevational view of the assembled device shown in FIG. 1.
Figure 6:
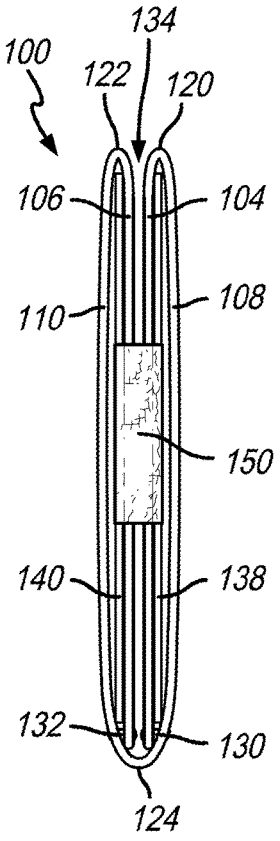
FIG. 6 is a left side elevational view of the assembled device shown in FIG. 1.
Figure 7:
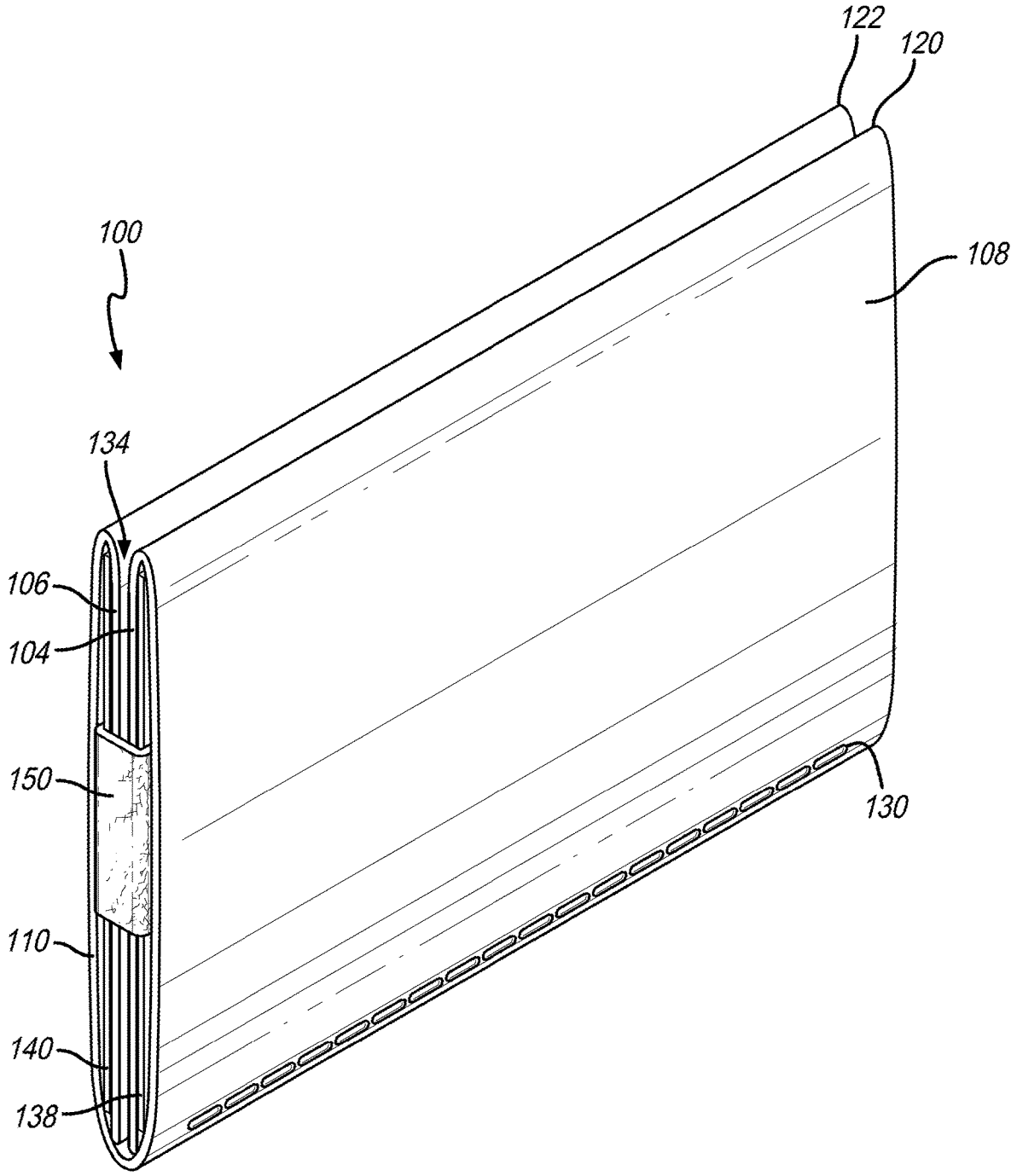
FIG. 7 is a perspective view of the assembled device shown in FIG. 1.
Figure 12:
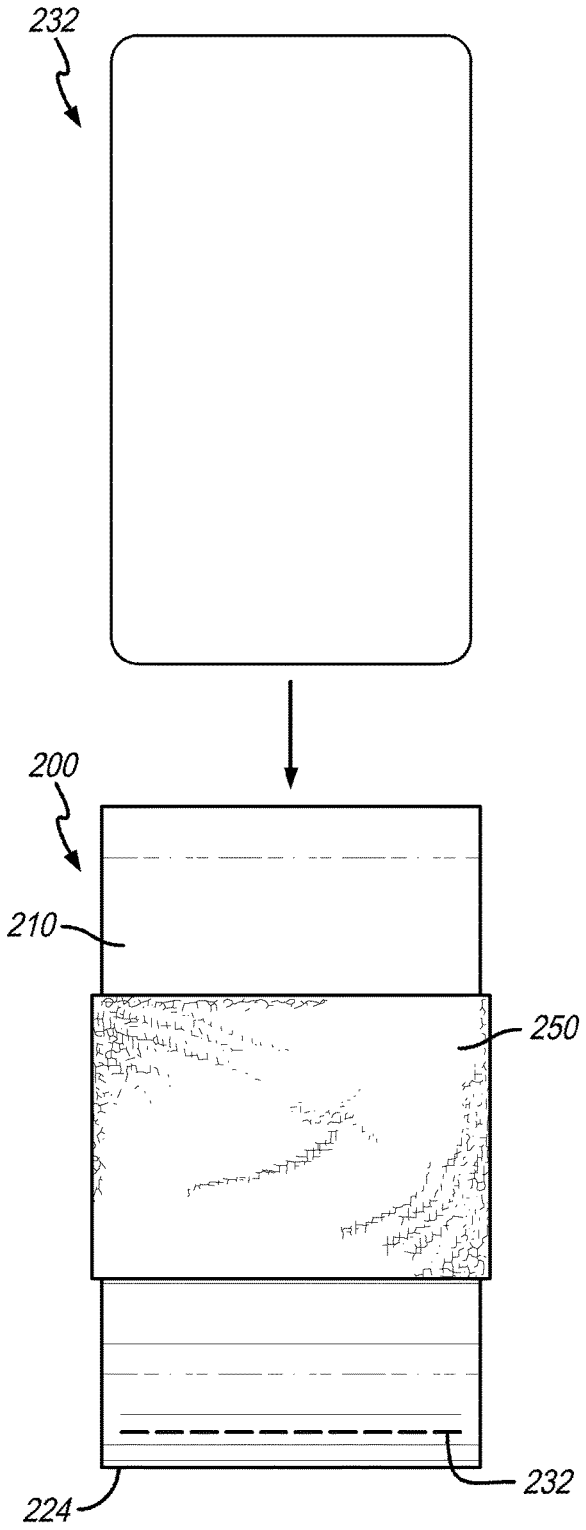
FIG. 12 is a rear elevational view of the assembled device shown in FIG. 8.
Figure 13:
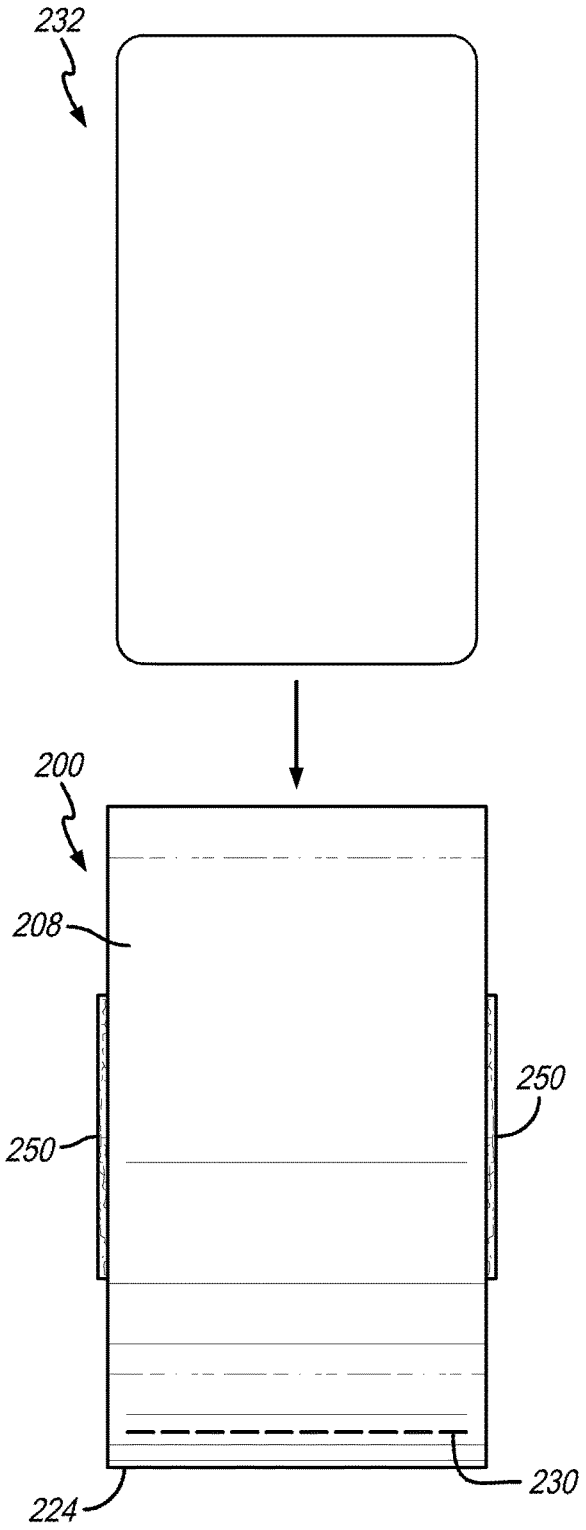
FIG. 13 is a front elevational view of the assembled device shown in FIG. 8.
Figure 14:
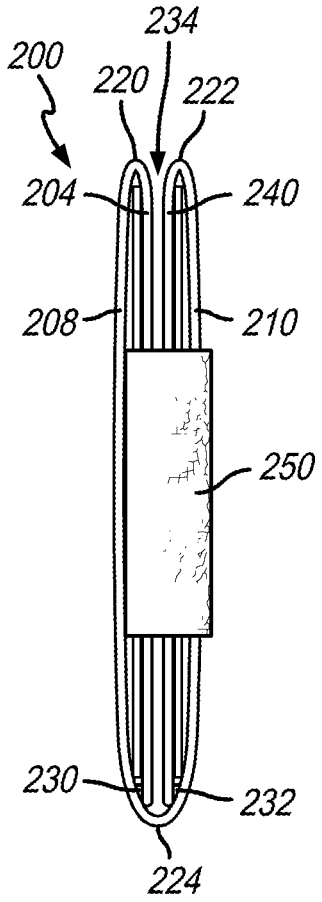
FIG. 14 is a left side elevational view of the assembled device shown in FIG. 8.
Figure 15:
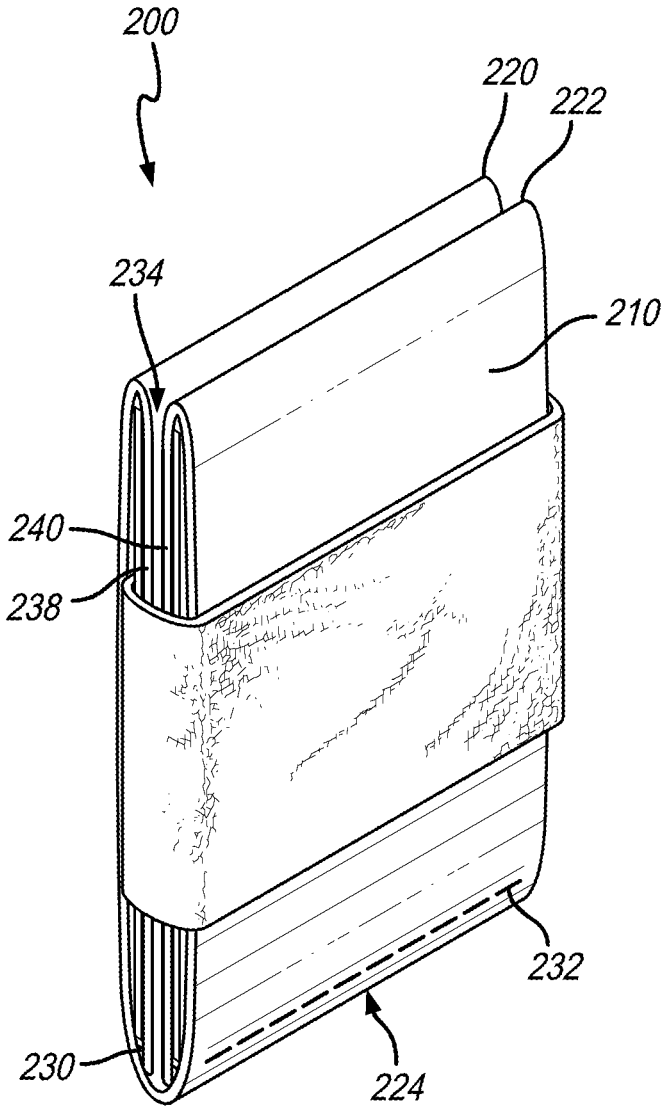
FIG. 15 is a perspective view of the assembled device shown in FIG. 8.

FIGS. 5, 12 and 13 show the assembled wallet and card holder 100, 200 with arrow 136, 236 showing the direction that a user can insert an exemplary card 132, 232 into slot 134, 234 in the wallet and card holder 100, 200. The completed wallet and card holder 100, 200 is also shown in FIGS. 6, 7, 14 and 15.

To use the wallet and card holder 100, 200 the user slides the strap member 150, 250 towards the third fold line 124, 224 to open up the compartment 134, 234. The user then expands the compartment 134, 234 slidably inserts the desired items (cards and/or money) into the compartment 134, 234 and slides the strap member 150, 250 in a closed position towards the first fold line 120, 220 and second fold line 1.22, 222. In the closed position, strap member 150, 250 keeps the contents of the compartment 134, 234 secure and compact, regardless of the amount of contents that are added and removed.

Figure 16:
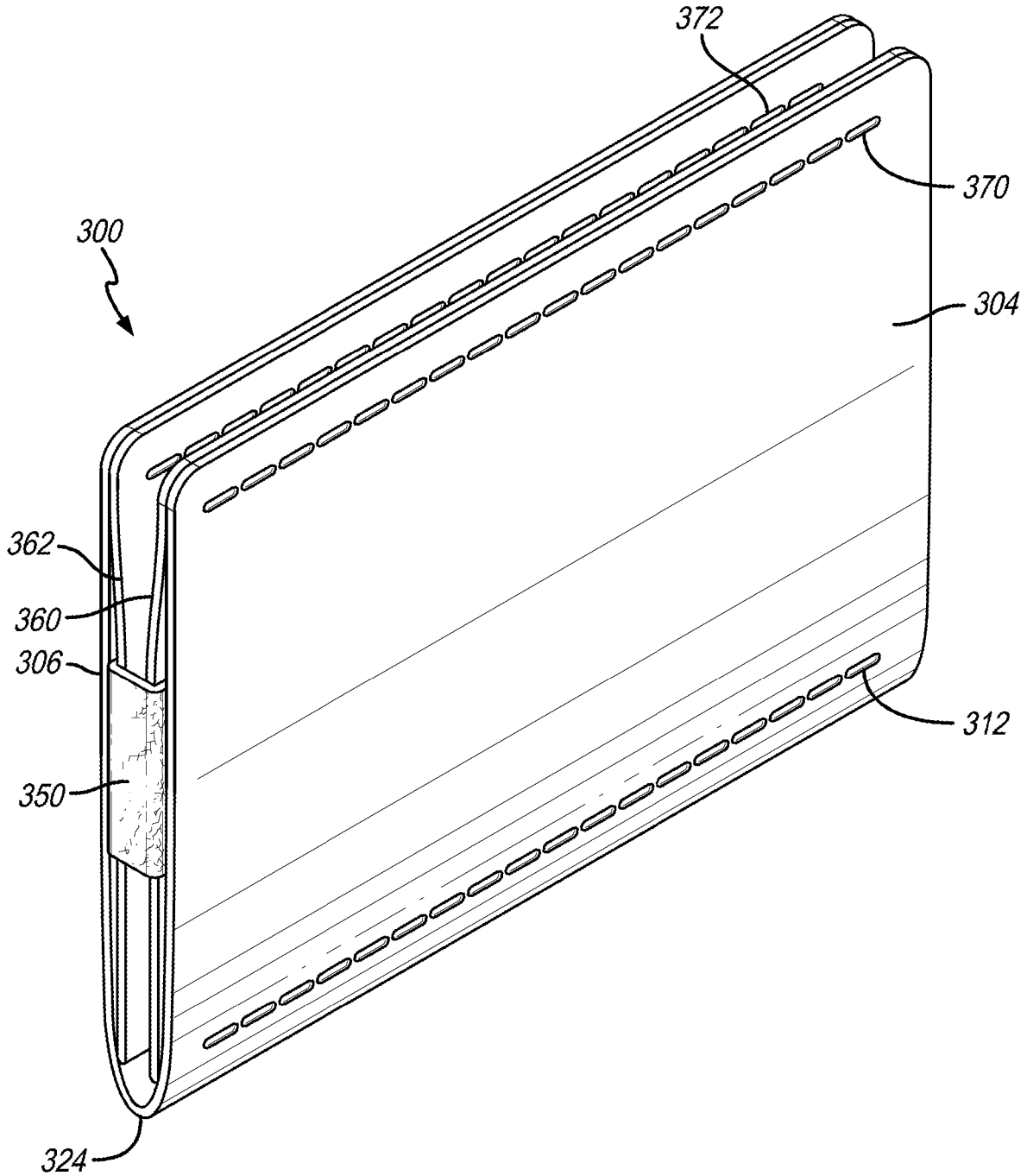
FIG. 16 is a perspective view of an alternative embodiment of the device of the present invention.
Figure 17:
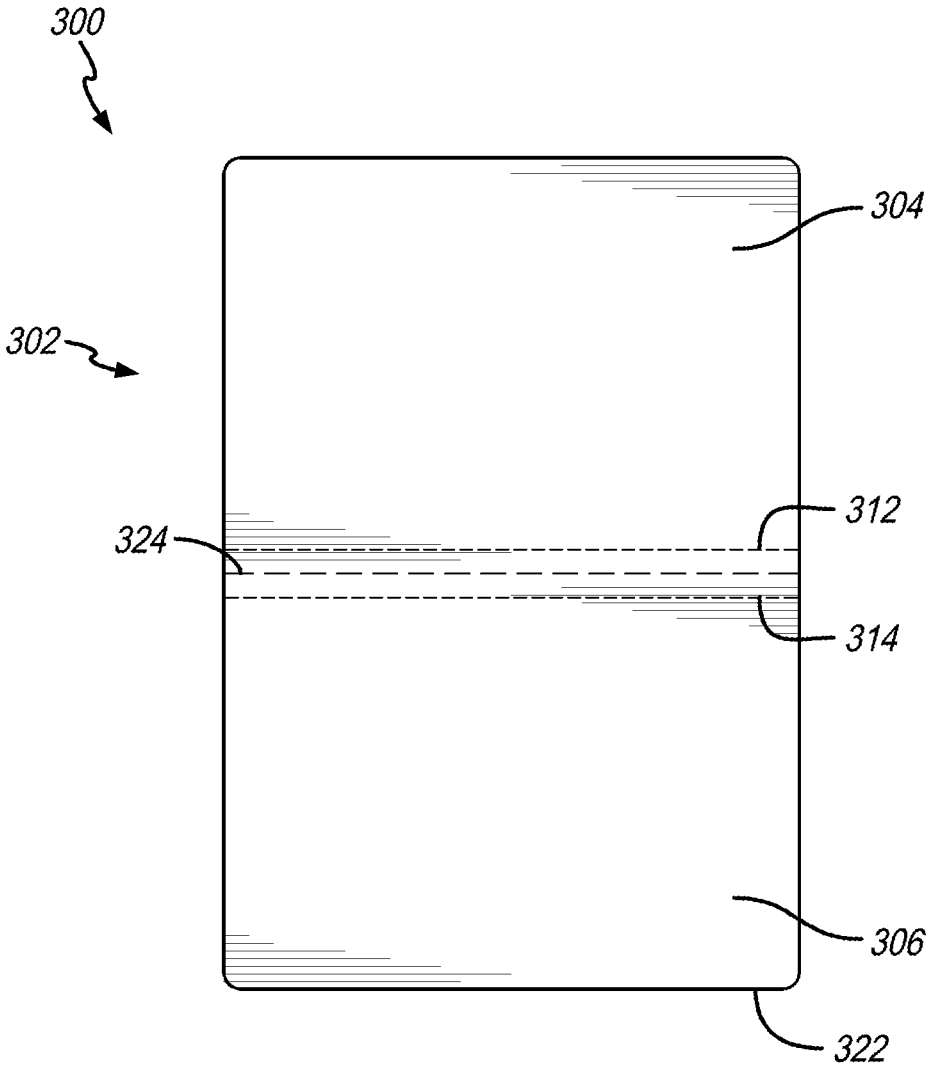
FIG. 17 is a front elevational view the device shown in FIG. 16 prior to assembly.
Figure 18:
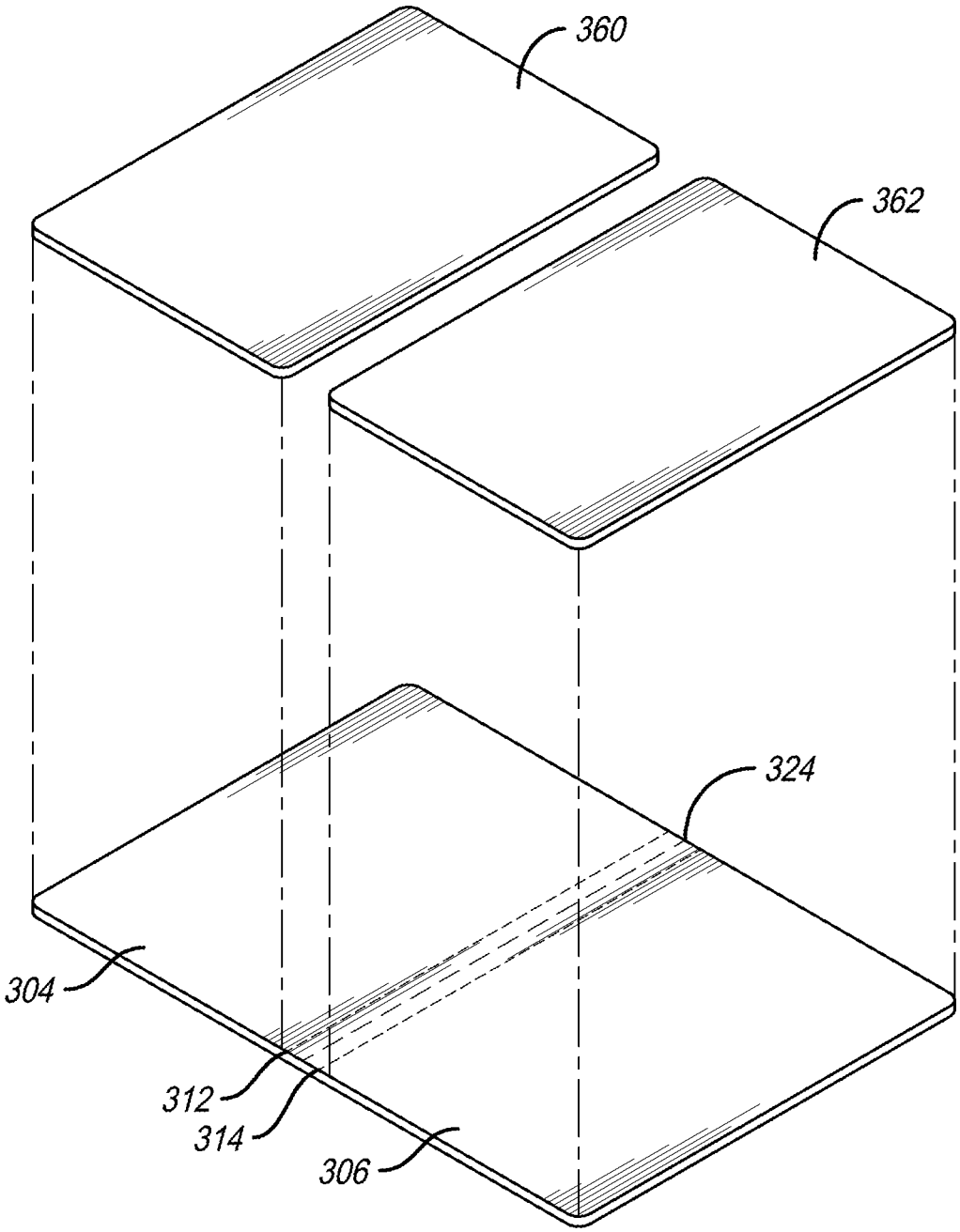
FIG. 18 is an exploded view of the device shown in FIG. 16.
Figure 19:
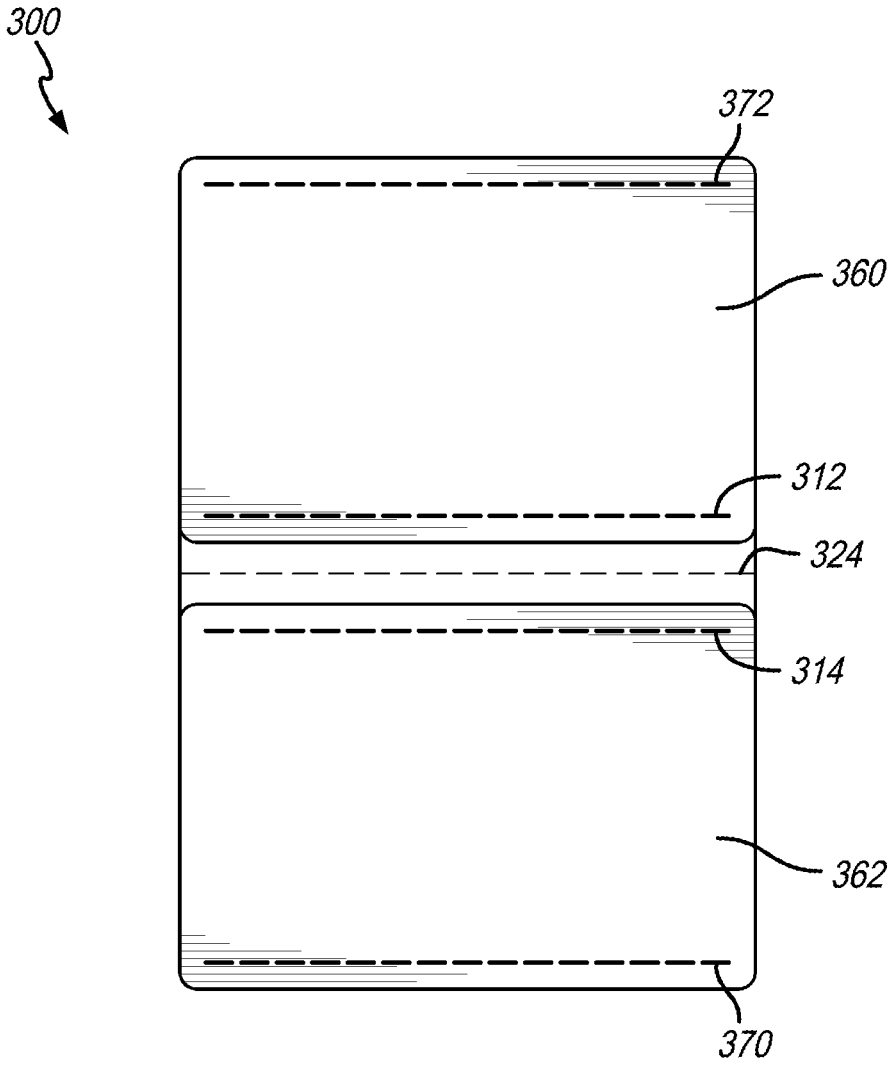
FIG. 19 is a front elevational view of the device shown in FIG. 16.

An alternative embodiment of the invention is shown in FIGS. 16 to 19. The device 300 comprises a blank pattern 302 with a first panel 304 and second panel 306, as shown in FIG. 17. The first panel 304 and second panel 304 are cut from one piece of material and are separated by fold line 324. A first rectangular material 360 and second rectangular material 362 are joined to blank pattern 302 by stitching 312, 370 at the first panel 304 and by stitching 314, 372 second panel 306 at 312 as shown in FIGS. 16 and 19. Preferably, the first rectangular material 350 and second rectangular material 352 are made from rigid material.

After the first rectangular material 350 and second rectangular material 352 are joined to the blank pattern 302, the blank pattern 302 is then folded along fold line 324 to provide an assembled wallet and card holder 300 is illustrated in FIG. 16. The assembled wallet and card holder is between about 2 inches to 4 inches wide, and between about 4 inches to 6 inches long.

A resilient strap member 350, shown in FIG. 16 is used to hold the first panel 304 and second panel 306 adjacent to each other. Strap member 350 can be made from any material, but is preferably made from a material that is expandable to a finished stretch of 50% to 100% so as to easily and securely hold several credit and other cards and foldable money. The strap member 350 has a width of from about between 0.5 inches and 1.5 inches, and a length of from about between 5 to 9 inches such that, when joined together, the strap member 350 fits securely around the wallet and holder 300. Preferably, strap member 350 is 1 inch wide and 7.5 inches long.

As shown in FIG. 19, strap member 350 is threaded between the first panel 304 and the first rectangular material 360, and the second panel 306 and the second rectangular material 362. The strap member 350 is then joined together, such as by stitching, so that it forms an endless band around the assembled device.

Once assembled, a compartment 334 is formed between the first rectangular material 350 and second rectangular material 352. The compartment 334 serves as a holder for storing currency, driver's license, business cards, credit card or the like. The user can digitally engage at least an end or side edge of the contents inserted in the compartment 334 in a finger pinching manner to slidably remove the contents from the compartment 334.

To use the wallet and card holder 300, the user slides the strap member 350 towards the fold line 324 to open up the compartment 334. The user then expands the compartment 334 slidably inserts the desired items into the compartment 334 and slides the strap member 350 in a closed position away from fold line 324. In the closed position, strap member 350 keeps the contents of the compartment 334 secure and compact, regardless of the amount of contents that are added and removed.

Although the present invention has been discussed in considerable detail with reference to certain embodiments, other embodiments are possible. Therefore, the scope of the appended claims should not be limited to the description of the embodiments contained in this disclosure. As used in this disclosure, except where the context requires otherwise, the method steps disclosed and shown are not intended to be limiting nor are they intended to indicate that each step is essential to the method or that each step must occur in the order disclosed. All references cited herein are incorporated by reference in their entirety.

What is claimed is:

1. A card and foldable currency carrying device, the device comprising:
   a. a substantially rectangular wallet assembly comprising:
      i. a first inside panel, a second inside panel, a third outside panel, and a fourth outside panel, wherein the first inside panel is proximate to the fourth outside panel and the second inside panel is proximate to the third outside panel, and wherein the first inside panel and the second inside panel comprise a compartment for holding one or more cards and foldable currency; and
   b. a non-removable strap member, wherein the non-removable strap member is slidable along the wallet assembly between a first open position and a second closed position, and wherein the non-removable strap member is secured between the first inside panel and the third outside panel.

2. The device of claim 1, wherein the one or more cards are selected from the group comprising credit cards, debit cards, ATM cards, gift cards, driver's licenses, identification cards, library cards, and business cards.

3. The device of claim 1, wherein the wallet assembly is constructed of at least one material selected from the group consisting of textiles, leather, cork, vegan leather, polyurethane synthetic leather, polyvinylchloride, silk and taffeta.

4. The device of claim 1, wherein device is between about 2 inches to 4 inches wide, and between about 4 inches to 6 inches long.

5. The device of claim 1, wherein the length of the strap member is greater in dimension than the width of the strap member.

6. The device of claim 1, wherein the non-removable strap member comprises a rectangular strip of elastic material, and wherein the rectangular strip of elastic material is from about between 0.5 inches to 1.5 inches wide, and from about between 5 inches to 9 inches long.

7. The device of claim 1, wherein the non-removable strap member comprises a rectangular strip of elastic material having a first end and a second end, and wherein the first end and second end are non reversibly joined together.

8. The device of claim 1, wherein the non-removable strap member in the first open position allows for the insertion of cards and money in the device.

9. The device of claim 1, wherein the non-removable strap member in the second closed position allows the cards and money to be retained in the device.

10. The device of claim 1, wherein the non-removable strap member is constructed of at least one material selected from the group consisting of fabric, elastic, spandex, lycra-type fabric, and rubber.

11. The device of claim 1, wherein one or more of the inside panels comprise one or more slots.

* * * * *